US006536590B1

(12) United States Patent
Godshaw et al.

(10) Patent No.: US 6,536,590 B1
(45) Date of Patent: Mar. 25, 2003

(54) SEMI-CYLINDRICAL BUCKET AND TOOL HOLDER

(75) Inventors: Donald E. Godshaw, Evanston, IL (US); Andrzej M. Redzisz, Skokie, IL (US)

(73) Assignee: Travel Caddy Inc., Des Plaines, IL (US)

( * ) Notice: Subject to any disclaimer, the term of this patent is extended or adjusted under 35 U.S.C. 154(b) by 0 days.

(21) Appl. No.: 09/836,308

(22) Filed: Apr. 17, 2001

Related U.S. Application Data

(60) Provisional application No. 60/197,654, filed on Apr. 17, 2000.

(51) Int. Cl.[7] ..... B65D 85/00

(52) U.S. Cl. ..... 206/373; 220/735; 248/210

(58) Field of Search ..... 206/372, 373, 206/376, 377, 806; 383/39, 40; 220/735; 248/210

(56) References Cited

U.S. PATENT DOCUMENTS

| | | | | | |
|---|---|---|---|---|---|
| 4,765,472 | A | | 8/1988 | Dent | |
| 4,993,551 | A | | 2/1991 | Lindsay | |
| 5,174,447 | A | * | 12/1992 | Fleming | 206/373 |
| D345,237 | S | | 3/1994 | Stein | |
| D354,596 | S | | 1/1995 | Dancyger | |
| D376,454 | S | * | 12/1996 | Fierek et al. | D3/905 |
| D388,919 | S | | 1/1998 | Maire et al. | |
| D396,912 | S | | 8/1998 | Maire et al. | |
| 5,813,530 | A | * | 9/1998 | Kornblatt | 182/129 |
| 5,833,095 | A | * | 11/1998 | Russell et al. | 206/373 |
| 5,848,701 | A | | 12/1998 | Riccabona | |
| D414,337 | S | | 9/1999 | Hubert | |
| 5,988,383 | A | * | 11/1999 | Armstrong | 182/129 |
| 6,085,902 | A | * | 7/2000 | Fang | 206/373 |
| 6,116,419 | A | * | 9/2000 | Campagna et al. | 182/129 |
| D445,202 | S | * | 7/2001 | Lungo | D25/68 |
| D446,617 | S | * | 8/2001 | Urbanski | D32/53 |
| 6,315,310 | B1 | * | 11/2001 | Hurt | 206/373 |

* cited by examiner

*Primary Examiner*—Shian Luong
(74) *Attorney, Agent, or Firm*—Banner & Witcoff, Ltd.

(57) ABSTRACT

A semi-cylindrical bucket and tool holder includes a molded plastic bucket enclosed and supported by a canvas bag having adjustable bottom straps and a top hook for attachment to the rung of a ladder.

7 Claims, 2 Drawing Sheets

SEMI-CYLINDRICAL BUCKET AND TOOL HOLDER

CROSS REFERENCE TO RELATED APPLICATION

This is a utility application based upon a previously filed provisional application, Ser. No. 60/197,654 filed Apr. 17, 2000, for which priority is claimed.

BACKGROUND OF THE INVENTION

In a principal aspect the present invention relates to a flexible, shaped bag, which is useful in combination with a semi-cylindrical bucket as a tool carrier.

Utilization of buckets such as 5-gallon cylindrical paint buckets in combination with a canvas bag insert for carrying tools and implements is disclosed in various prior art patents. Such combinations are often cumbersome and difficult to carry and store. Additionally, such items are difficult to use in a work environment particularly in an environment where ladders or scaffolding is being used because the cylindrical shape of the combination is difficult to carry. Thus there has developed a need for an improved tool holder and carrier.

SUMMARY OF THE INVENTION

Briefly, the present invention comprises the combination of a semi-cylindrical bucket and a flexible semi-cylindrical shaped bag into which the bucket is placed. The semi-cylindrical bag includes a planar side with an attachment hook along its top edge so that the combination may be easily carried or supported by the rung of a ladder or the brace of a scaffold.

Thus it is an object of the invention to provide an improved tool bucket carrier and holder.

It is a further object of the invention to provide a semi-cylindrical bucket tool holder which includes multiple pockets, which may be easily carried, which may be supported on the rung of a ladder in a balanced fashion, and which may be adjusted to accommodate various sizes of semi-cylindrical buckets.

If is a further object of the invention to provide a tool holder comprised of a bucket for example, a plastic molded bucket, having a semi-cylindrical shape and a compatible flexible carrying bag for the bucket.

There and other objects, advantages, and features of the invention will be set forth in the detailed description which follows.

BRIEF DESCRIPTION OF THE DRAWING

In the detailed description which follows, reference will be made to the drawing comprised of the following figures.

DESCRIPTION OF THE PREFERRED EMBODIMENT

Figure 1:
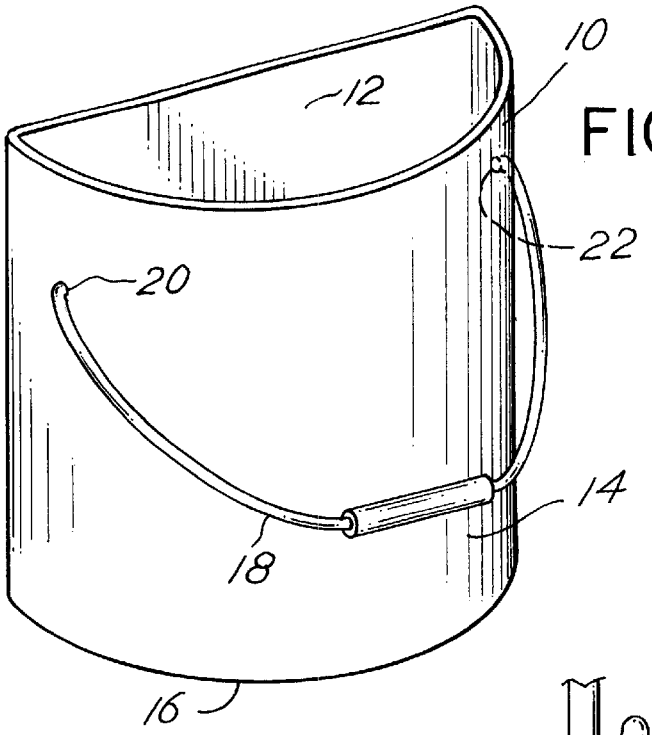
FIG. 1 is an isometric view of a semi-cylindrical bucket which is used in the combination of the invention.
Figure 2:
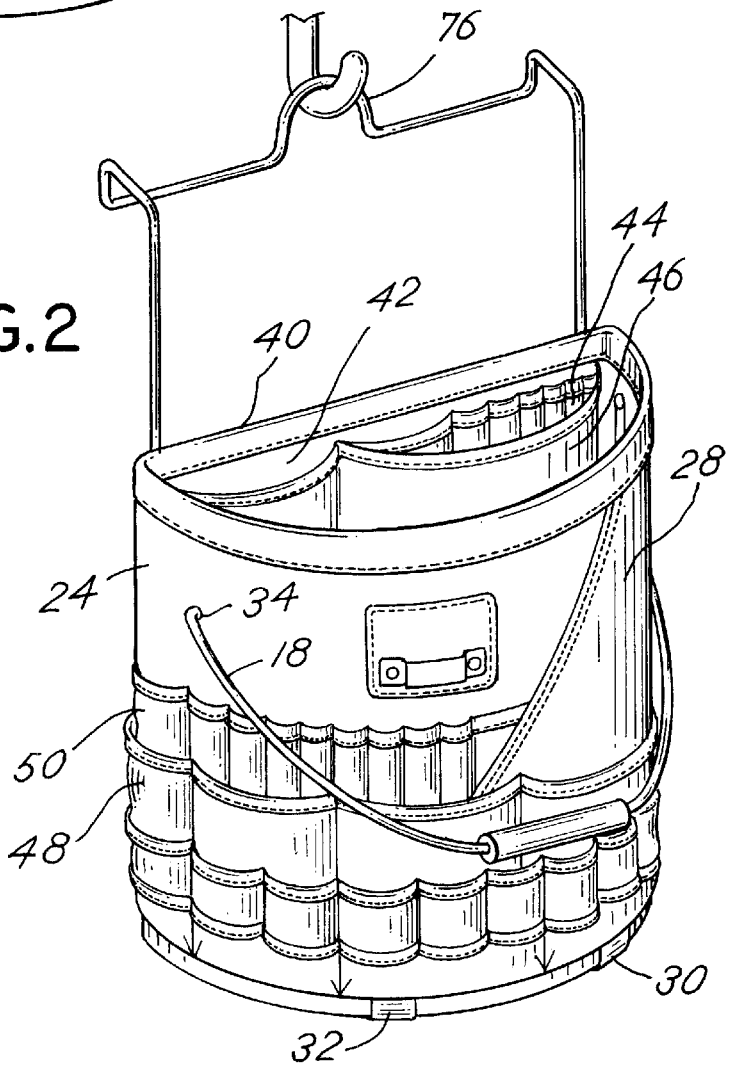
FIG. 2 is an isometric view of the bucket of FIG. 1 in combination with a flexible bag and hook comprising the invention.
Figure 3:
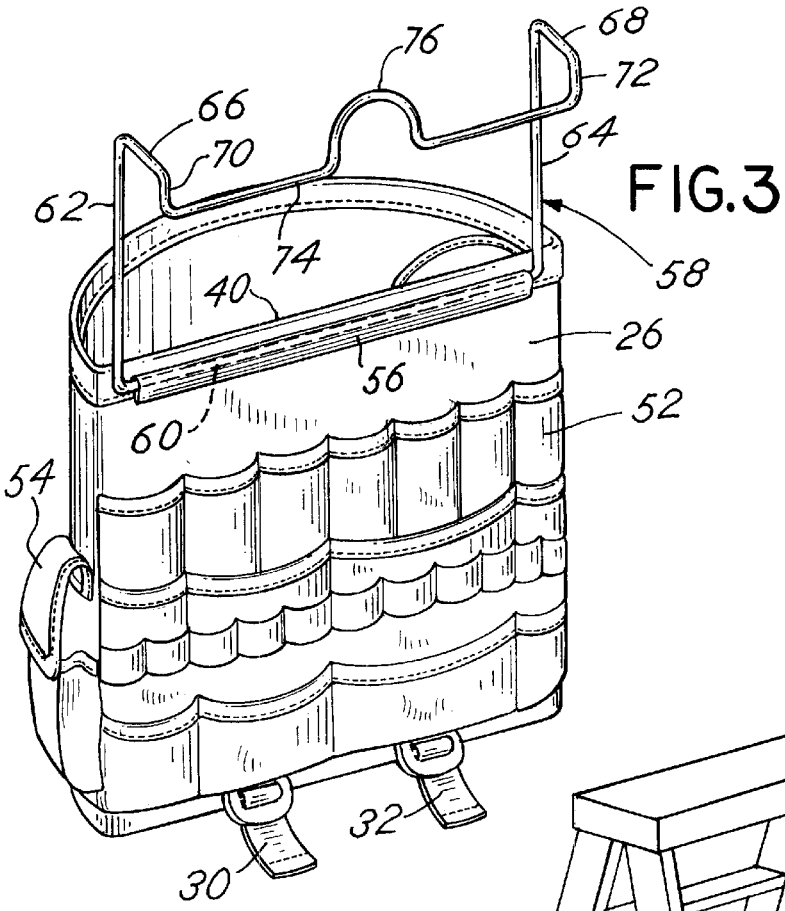
FIG. 3 is an isometric view of the combination of FIG. 2 as viewed from the reverse side depicted in FIG. 2.

The present invention is especially useful with a semi-cylindrical bucket, such as bucket 10 in FIG. 1. The bucket

10 includes a planar side wall 12 and a semi-cylindrical side wall 14 joined thereto. A bottom wall 16 completes the container comprising the bucket. The bucket 10 is typically be made from metal or a molded plastic material. The 10 bucket further includes a handle 18 which is connected at spaced or first and second connection points 20 and 22 to the semi-cylindrical side wall or surface 14.

The bucket 10 is utilized in combination with and cooperates with a flexible bag 24. The flexible bag 24 may be manufactured from a canvas material, by way of example, and includes a generally planar back side wall 26 and a semi-cylindrical front side wall 28 joined or stitched or integral with the back side wall 26 and sized in a manner which permits the bucket 10 to be received thereby. The bottom of the flexible bag 24 may comprise a planar panel or alternatively first and second adjustable straps 30 and 32 which connect the front side wall 28 with the back side wall 26. The utilization of straps 30 and 32 permits adjustment of the position of the bucket 10 within the sheath formed by the back side wall 26 and front side wall 28.

The front side wall 28 includes two openings 34 (only one is depicted) for receipt of the ends of handle 18 for connection to connection points 20 and/or 22. The front side wall 28 and back side wall 26 further define a circumferential top edge 40 with a depending apron or skirt 42 which fits within the interior of the bucket 10. The skirt 42 may encompass or surround the entire inside of the bucket 10 or only a portion thereof. The apron 42 further includes various pockets, such as pockets 44 and 46 which, in this circumstance, happen to be open along the top thereof for receipt of tools such as screwdrivers, pliers, etc.

Similarly, the outside of the front side wall 28 includes various pockets 48 and 50 arrayed and formed thereon. Likewise, back side wall 26 includes pockets, such as pocket 52. Pouches 54 with closure flaps may also be provided on the outside of the front side wall 28 and/or back side wall 26. However, the preferred construction does not incorporate a pouch on the outside of the backside wall 26.

Figure 4:
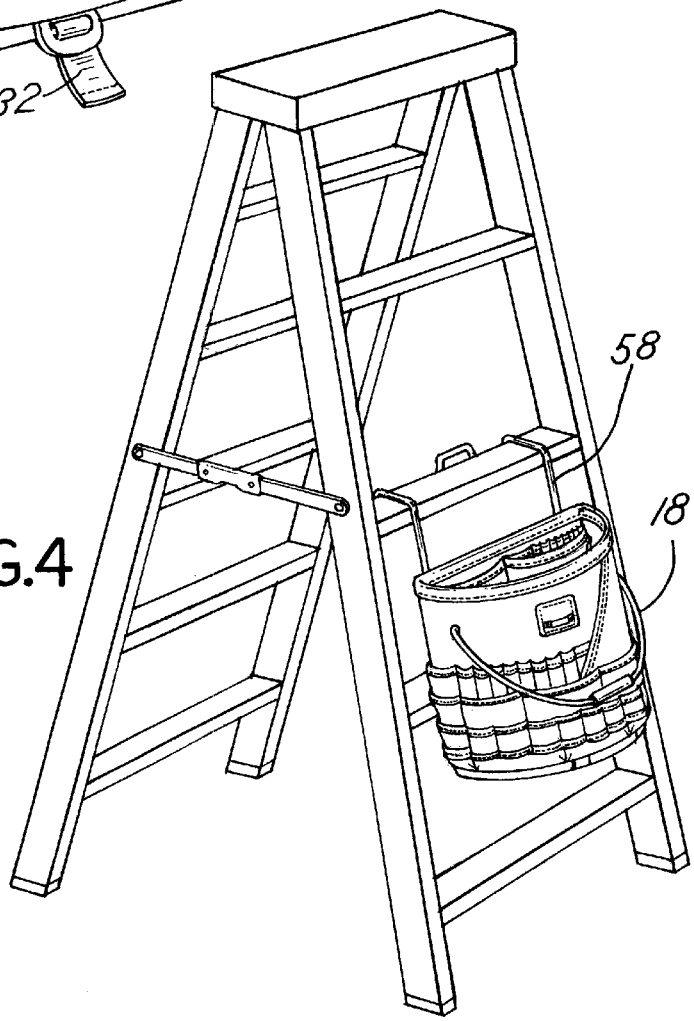
FIG. 4 is an isometric view of the bag and bucket combination of FIGS. 2 and 3 depicted in a typical workplace situation as supported on a stepladder.

The back side wall 26 includes a fabric sleeve 56 along the top edge 40. The sleeve 56 receives a run of a formed metal frame on loop 58. Loop 58 is comprised of a first or horizontal run 60, a first vertical run 62, a second spaced vertical run 64 parallel to the first run 62 and extending upwardly from the horizontal run 60. The runs 62 and 64 connect with lateral horizontal extensions 66 and 68 respectively, downwardly extending sections 70 and 72 respectively and a horizontal connecting run 74. The connecting run 74 preferably, but optionally includes a loop section 76 at the midpoint thereof. The loop section 76 permits hanging the entire combination from a rod or hook (not shown) in a balanced position. The described wire metal loop or member 58 defines a hook which, as depicted in FIG. 4, serves to support the combination on a rung of a stepladder, for example, or on a brace of a scaffold, etc. The loop member 58, however, may be used to support the tool holder on any type of horizontal support by hanging therefrom. It is especially useful in the environment depicted, however, on a stepladder or ladder.

The handle 18 permits the tool holder to be easily carried from one point to the next with tools within the bucket 10 as well as in the various pockets described. The flat side 26 facilitates balance of the tool holder and contents when carried or on a ladder as depicted.

It is possible to vary the design and position of the pockets described and depicted. It is also possible to eliminate certain parts of the construction, such as the handle or the apron which fits into the bucket. It is also possible to extend the apron for the full length of the interior of the bucket. Various other combinations and permutations are possible within the spirit and scope of the invention. The invention is therefore limited only by the following claims and equivalents thereof.

What is claimed is:

1. A tool carrier comprising, in combination:

a rigid bucket having a semi-cylindrical configuration with a flat side wall joined to a generally semi-cylindrical side wall;

a bottom wall, an open top and a handle joined to the semi-cylindrical side wall, at a first and a second spaced connection position;

a flexible bag with an open top having a shape congruent with the rigid bucket for receiving the bucket, said bag including a side wall panel fitted over the semi-cylindrical side wall of the bucket and including first and second openings for receipt of the handle attached to the connection positions;

said flexible bag including a planar side wall panel fitted over the flat side wall of the bucket;

a support hook attached to side wall panel of the flexible bag, said hook including a first run extending from the side wall panel away from the open top and a hook projecting generally transversely from the first run for fitting over a rib, step or ledge to support the bucket.

2. The combination of claim 1 wherein the support hook comprises a loop rod with a lower horizontal run attached to the side wall panel, said first run extending vertically from the lower run, a second space vertical parallel run extending from the horizontal run, a third shaped horizontal run forming a hook for hanging support.

3. The combination of claim 2 wherein the third run includes a loop center section for supporting the bucket on a hook member.

4. The combination of claim 1, including a top edge on the flexible bag and a depending apron on the top edge folded into the bucket.

5. The combination of claim 1 or 4 including a plurality of formed pockets on the flexible bag.

6. The combination of claim 4 including a plurality of formed pockets with open tops on the outside of the flexible bag and on the apron within the bucket.

7. A tool carrier comprising, in combination:

a rigid bucket having a semi-cylindrical configuration with a flat side wall joined to a generally semi-cylindrical side wall;

a bottom wall and an open top;

a flexible bag with an open top having a shape congruent with the rigid bucket for receiving the bucket, said bag including a side wall panel fitted over the semi-cylindrical side wall of the bucket and including first and second openings for receipt of a handle attached to connection positions of the bucket;

said flexible bag including a planar side wall panel fitted over the flat side wall of the bucket;

a support hook attached to side wall panel of the flexible bag, said hook including a first run extending from the side wall panel away from the open top and a hook projecting generally transversely from the first run for fitting over a rib, step or ledge to support the bucket.

* * * * *